US008327591B2

(12) United States Patent
Wilkinson, Jr. et al.

(10) Patent No.: US 8,327,591 B2
(45) Date of Patent: Dec. 11, 2012

(54) OVERHEAD PANEL AND INSTALLATION SYSTEM

(76) Inventors: Edgar L. Wilkinson, Jr., Cincinnati, OH (US); Arthur L. Wilkinson, Loveland, OH (US)

( * ) Notice: Subject to any disclaimer, the term of this patent is extended or adjusted under 35 U.S.C. 154(b) by 151 days.

(21) Appl. No.: 12/730,568

(22) Filed: Mar. 24, 2010

(65) Prior Publication Data

US 2011/0232219 A1 Sep. 29, 2011

(51) Int. Cl.
*E04F 13/21* (2006.01)
*E04F 13/09* (2006.01)

(52) U.S. Cl. ..... 52/243.1; 52/238.1; 52/474; 52/506.07; 52/710

(58) Field of Classification Search ..... 52/126.3, 52/238.1, 239, 243.1, 474, 506.07, 710; 40/607.13, 40/617; 160/38
See application file for complete search history.

(56) References Cited

U.S. PATENT DOCUMENTS

| | | | | |
|---|---|---|---|---|
| 160,260 | A | | 3/1875 | Disney |
| 1,541,655 | A | | 6/1925 | Parris |
| 1,739,057 | A | | 12/1929 | Bock |
| 2,376,279 | A | | 5/1945 | Erwin |
| 2,863,185 | A | | 12/1958 | Riedi |
| 2,882,564 | A | | 4/1959 | Couse |
| 2,991,889 | A | | 7/1961 | Levy |
| 3,084,464 | A | | 4/1963 | Ladbury |
| 3,159,514 | A | | 12/1964 | Constantine et al. |
| 3,160,281 | A | | 12/1964 | Ruhnke |
| 3,256,668 | A | * | 6/1966 | Downes ..... 52/769 |
| 3,297,374 | A | | 1/1967 | Radek |
| 3,310,917 | A | | 3/1967 | Simon |
| 3,407,525 | A | | 10/1968 | Connell |
| 3,410,042 | A | * | 11/1968 | Averill ..... 52/243.1 |
| 3,426,489 | A | | 2/1969 | Lambert |
| 3,449,877 | A | * | 6/1969 | Beckman ..... 52/243.1 |
| 3,512,819 | A | | 5/1970 | Gillingwater |
| 3,531,884 | A | | 10/1970 | Adler |
| 3,535,807 | A | | 10/1970 | Baldwin |
| 3,557,499 | A | * | 1/1971 | Dickie et al. ..... 52/36.4 |
| 3,557,507 | A | | 1/1971 | Wilder |
| 3,563,582 | A | | 2/1971 | Jacob |
| 3,593,475 | A | * | 7/1971 | LaGue ..... 52/241 |
| 3,640,039 | A | | 2/1972 | McKee |
| 3,641,730 | A | | 2/1972 | Meckstroth |
| 3,683,100 | A | * | 8/1972 | Deal et al. ..... 174/491 |
| 3,696,541 | A | | 10/1972 | Pittman |
| 3,708,941 | A | * | 1/1973 | Cuckson ..... 52/506.08 |
| 3,744,199 | A | * | 7/1973 | Navarre ..... 52/481.2 |
| 3,748,793 | A | * | 7/1973 | Tompkins et al. ..... 52/64 |
| 3,831,339 | A | | 8/1974 | Piralli |

(Continued)

FOREIGN PATENT DOCUMENTS

GB 2275939 A * 9/1994

*Primary Examiner* — Basil Katcheves
*Assistant Examiner* — Rodney Mintz
(74) *Attorney, Agent, or Firm* — Wood, Herron & Evans, LLP

(57) ABSTRACT

An overhead panel assembly for coupling to a drop ceiling includes a support channel and a clip coupling the support channel to a grid member of the drop ceiling. The overhead panel assembly further includes a vertical panel received over and coupled to the support member with a plurality of binding members. A plurality of clips, support channels, and vertical panels may be positioned in series along a drop ceiling to form a decorative soffit, valance, display, or other structure.

17 Claims, 5 Drawing Sheets

U.S. PATENT DOCUMENTS 3,971,477 A 7/1976 Bruderly
3,979,869 A 9/1976 Beehler
4,035,940 A 7/1977 Mickey
4,037,380 A * 7/1977 Pollock ..... 52/475.1
4,046,083 A 9/1977 Murdoch et al.
4,068,434 A 1/1978 Day
4,070,838 A * 1/1978 Kuhn ..... 52/204.597
4,073,108 A * 2/1978 Williams ..... 52/238.1
4,079,553 A * 3/1978 Kirk, Jr. ..... 52/71
4,086,734 A * 5/1978 Hayashi ..... 52/126.4
4,093,078 A 6/1978 Radek
4,112,647 A * 9/1978 Scheid ..... 52/481.2
4,128,983 A 12/1978 Matsubara
4,147,004 A 4/1979 Day et al.
4,151,691 A * 5/1979 Wendt ..... 52/242
4,154,035 A * 5/1979 Wendt ..... 52/243.1
4,186,666 A 2/1980 Honickman
4,209,953 A * 7/1980 Wendt ..... 52/241
4,253,578 A 3/1981 Rekow
4,263,761 A * 4/1981 Kristoff ..... 52/241
4,277,920 A * 7/1981 Dixon ..... 52/64
4,326,637 A 4/1982 James
4,380,298 A 4/1983 Harig
4,415,090 A 11/1983 Bustos
4,434,596 A * 3/1984 McAteer et al. ..... 52/243.1
4,461,107 A 7/1984 Grate
4,508,231 A 4/1985 Honickman
D279,585 S 7/1985 Seggerson et al.
4,608,066 A * 8/1986 Cadwell, Jr. ..... 55/385.1
4,625,476 A * 12/1986 Shimada ..... 52/126.4
4,662,128 A * 5/1987 Eberdt et al. ..... 52/71
4,700,515 A * 10/1987 Menchetti et al. ..... 52/126.1
4,703,598 A * 11/1987 Wilson et al. ..... 52/238.1
4,774,794 A 10/1988 Grieb
4,899,509 A * 2/1990 Power ..... 52/238.1
4,905,428 A * 3/1990 Sykes ..... 52/126.4
4,908,915 A 3/1990 Ruggles
4,926,606 A 5/1990 Hanson
4,944,416 A 7/1990 Petersen
4,948,313 A * 8/1990 Zankovich ..... 411/85
4,989,386 A 2/1991 Collis
5,010,702 A * 4/1991 Daw et al. ..... 52/241
5,048,701 A 9/1991 Simpson
5,058,333 A 10/1991 Schwartz
5,062,246 A * 11/1991 Sykes ..... 52/126.4
5,065,537 A 11/1991 Bailey
5,086,606 A * 2/1992 Finses ..... 52/791.1
5,131,448 A 7/1992 Miller
5,138,812 A 8/1992 Palmersten
5,140,792 A * 8/1992 Daw et al. ..... 52/238.1
5,148,925 A 9/1992 Althoff
5,166,497 A * 11/1992 Meyer et al. ..... 219/213
5,167,191 A 12/1992 Muth
5,233,803 A * 8/1993 Bockmiller ..... 52/239
5,237,786 A * 8/1993 Kochansky ..... 52/126.4
5,260,325 A 11/1993 Markwalder
5,279,089 A 1/1994 Gulur
5,325,641 A * 7/1994 Felton ..... 52/36.4
5,339,576 A 8/1994 Fussler
5,343,665 A 9/1994 Palmersten
5,381,991 A * 1/1995 Stocker ..... 248/206.5
5,404,675 A * 4/1995 Schmidhauser ..... 49/409
5,409,191 A * 4/1995 Wenmaekers ..... 248/317
5,411,072 A * 5/1995 Starck et al. ..... 160/84.11
5,471,804 A 12/1995 Winter
5,471,805 A * 12/1995 Becker ..... 52/241
5,479,733 A * 1/1996 Kusina ..... 40/785
5,497,889 A 3/1996 Genovesi
5,509,242 A 4/1996 Rechsteiner
5,524,402 A * 6/1996 Sykes ..... 52/243.1
5,603,192 A * 2/1997 Dickson ..... 52/238.1
5,644,877 A * 7/1997 Wood ..... 52/241
5,655,344 A * 8/1997 Moen et al. ..... 52/238.1
5,687,956 A 11/1997 Vesper
5,898,987 A 5/1999 Onofrio
5,921,044 A 7/1999 Holztrager
5,934,039 A 8/1999 Guy
5,946,874 A 9/1999 Roberts
5,946,875 A 9/1999 Jeanseau
5,992,109 A * 11/1999 Jonker ..... 52/238.1
6,014,849 A 1/2000 Yonemura
6,053,460 A 4/2000 Wilkinson et al.
6,094,875 A * 8/2000 Laine ..... 52/220.7
6,108,955 A 8/2000 Folsom et al.
6,108,994 A 8/2000 Bodine
6,155,014 A * 12/2000 Wagner ..... 52/281
6,215,881 B1 4/2001 Azima et al.
6,230,463 B1 5/2001 Bodine
6,318,042 B1 11/2001 Bloom et al.
6,363,645 B1 4/2002 Hunter
6,409,415 B1 * 6/2002 Toder ..... 403/397
6,418,689 B1 * 7/2002 Hacquard et al. ..... 52/474
6,453,633 B1 9/2002 Wilkinson, Jr. et al.
6,481,172 B1 11/2002 Porter
6,663,054 B2 12/2003 Robicheau
6,672,018 B2 1/2004 Shingleton
RE38,463 E * 3/2004 Anderson et al. ..... 248/329
6,729,585 B2 * 5/2004 Ogden ..... 248/58
6,799,404 B2 * 10/2004 Spransy ..... 52/582.1
6,889,473 B2 * 5/2005 Westra ..... 52/64
6,945,414 B1 9/2005 Stevens et al.
7,036,196 B2 5/2006 Salatin et al.
7,096,633 B1 8/2006 Bowen
7,104,023 B1 9/2006 Holztrager
7,117,998 B2 10/2006 Krapf
7,152,383 B1 12/2006 Wilkinson, Jr.
D568,060 S 5/2008 Munson
7,478,504 B2 * 1/2009 Huebner et al. ..... 52/238.1
7,624,549 B2 * 12/2009 Kopish ..... 52/243.1
7,640,701 B2 * 1/2010 Rutherford ..... 52/243
7,730,670 B2 * 6/2010 Whitaker ..... 49/409
7,730,682 B2 * 6/2010 Nash ..... 52/238.1
7,886,496 B1 * 2/2011 Spransy ..... 52/506.06
7,958,684 B2 * 6/2011 Kleege ..... 52/243.1
8,033,068 B2 * 10/2011 Luttmann et al. ..... 52/243.1
8,051,616 B2 * 11/2011 George ..... 52/243.1
8,091,301 B2 * 1/2012 Van Klaveren ..... 52/243.1
8,161,705 B2 * 4/2012 Pratt ..... 52/506.05
8,181,405 B2 * 5/2012 Nash ..... 52/238.1
2002/0157335 A1 * 10/2002 Vos ..... 52/238.1
2003/0070337 A1 4/2003 Music
2003/0089057 A1 * 5/2003 Wiechecki et al. ..... 52/238.1
2003/0154672 A1 * 8/2003 Spransy et al. ..... 52/238.1
2003/0172569 A1 * 9/2003 Wickwire ..... 40/617
2003/0208938 A1 * 11/2003 Cink et al. ..... 40/617
2006/0101744 A1 * 5/2006 Falbaum et al. ..... 52/238.1
2006/0101745 A1 * 5/2006 Kleege ..... 52/243.1
2006/0144001 A1 7/2006 Capozzo
2007/0039259 A1 * 2/2007 MacDonald et al. ..... 52/238.1
2007/0079735 A1 * 4/2007 Bobis et al. ..... 108/102
2007/0094963 A1 * 5/2007 McDonald et al. ..... 52/270
2007/0107325 A1 * 5/2007 Klein ..... 52/126.3
2008/0209827 A1 * 9/2008 Webb ..... 52/220.7
2008/0295426 A1 * 12/2008 Milligan et al. ..... 52/238.1
2009/0049766 A1 * 2/2009 Kopish ..... 52/167.1
2009/0113799 A1 * 5/2009 Luttmann et al. ..... 49/127
2009/0293405 A1 * 12/2009 Andrews et al. ..... 52/578
2010/0154322 A1 * 6/2010 Williams ..... 52/95
2012/0096780 A1 * 4/2012 Metcalf et al. ..... 52/173.1

* cited by examiner

OVERHEAD PANEL AND INSTALLATION SYSTEM

TECHNICAL FIELD

This invention relates to overhead panel installations, and more specifically to lightweight panels coupled with a ceiling to form soffits, valances, and displays, and other structural elements.

BACKGROUND

In many commercial buildings, it is desirable to aesthetically separate areas of a large space with overhead panels or decorative valances projecting downward from a ceiling. These overhead panels are also referred to as soffits, valances, and bulkheads in different settings. Alternatively, overhead panels may be connected to a ceiling to provide a vertical mounting surface for advertising information, menu information, or other displays in various retail establishments. The overhead panels must have substantial thickness in order to achieve the desired decorative effect. However, the weight of these overhead panels requires significant structural elements mounted to a ceiling of the building. Many overhead panels also must be installed using hoists or similar mechanical lifting devices.

In many buildings, such as "big box" buildings having very high structural ceilings, a so-called drop ceiling is installed below the higher structural ceiling and duct work. The drop ceiling might define an area such as a food court, customer service area, or smaller retail area within the larger store. The drop ceiling includes a plurality of ceiling support members suspended from the higher ceiling and interconnected to form a grid in a horizontal plane. The drop ceiling also includes a plurality of lightweight ceiling tiles supported on the grid. Any soffits or bulkheads thus, would extend downwardly below the drop ceiling within such installations. For many reasons, a business may not desire to, or may not be actually allowed or able to, install any structure above the drop ceiling for supporting the soffit or bulkhead structures. For example, added structural members extending above the drop ceiling may interfere with air vents, wiring, and other installations concealed between the structural ceiling and the drop ceiling. Furthermore, such construction requires additional equipment to reach the higher structural ceiling and also may require that the drop ceiling be partially disassembled.

Also, existing overhead panel installations require additional structural elements to be connected to the higher structural ceiling at suitable anchor points to support the significant weight of the overhead panels. However, these installations are expensive, and may not be an option for businesses that cannot install structures above a drop ceiling in a building. Thus, it would be desirable to utilize an overhead panel installation for the purposes of creating soffits, valances, bulkheads, or other structures in areas covered by a drop ceiling.

SUMMARY

The invention according to one embodiment includes an overhead panel assembly for coupling to a drop ceiling. The overhead panel assembly includes an elongate support channel coupled to a grid member of the drop ceiling. The overhead panel assembly further includes a vertical panel received over and coupled to the elongate support member with a plurality of binding members. A plurality of support channels and vertical panels may be positioned in series along a drop ceiling to form a decorative soffit, valance, bulkhead, or other structure.

In an exemplary embodiment, the elongate support channel has an upper horizontal plate section and a pair of vertical sidewall sections extending downwardly from the ends of the upper horizontal plate section. The upper horizontal plate section includes a plurality of top apertures, and the vertical sidewall sections include a plurality of side apertures. A grid clip includes a horizontal portion and a hook arm. The hook arm slides into engagement with a grid member of the drop ceiling. The horizontal portion includes an attachment member extending down from the hook arm and extending through the top apertures of the support channel to connect the support channel and the clip. The elongate vertical panel has a cellular core and a groove formed in the cellular core along an elongate upper edge. The groove is sized to receive the support channel and engage the pair of vertical sidewalls of the support channel. The binding members extend through the vertical panel and the side apertures in the support channel to connect the panel to the support channel.

A method of assembling a decorative soffit, valance, or other structure from a drop ceiling is also disclosed. The method includes sliding a hook arm of a grid clip into engagement with a grid member of the drop ceiling, and coupling a top surface of a support channel to the grid clip. The method also includes sliding a vertically-oriented panel over the support channel so that the panel surrounds both side surfaces of the support channel. The method further includes coupling the vertically-oriented panel to the side surfaces of the support channel.

BRIEF DESCRIPTION OF THE DRAWINGS

The accompanying drawings, which are incorporated in and constitute a part of this specification, illustrate an embodiment of the invention and, together with a general description of the invention given below, serve to explain the principles of the invention.

DETAILED DESCRIPTION

Figure 1:
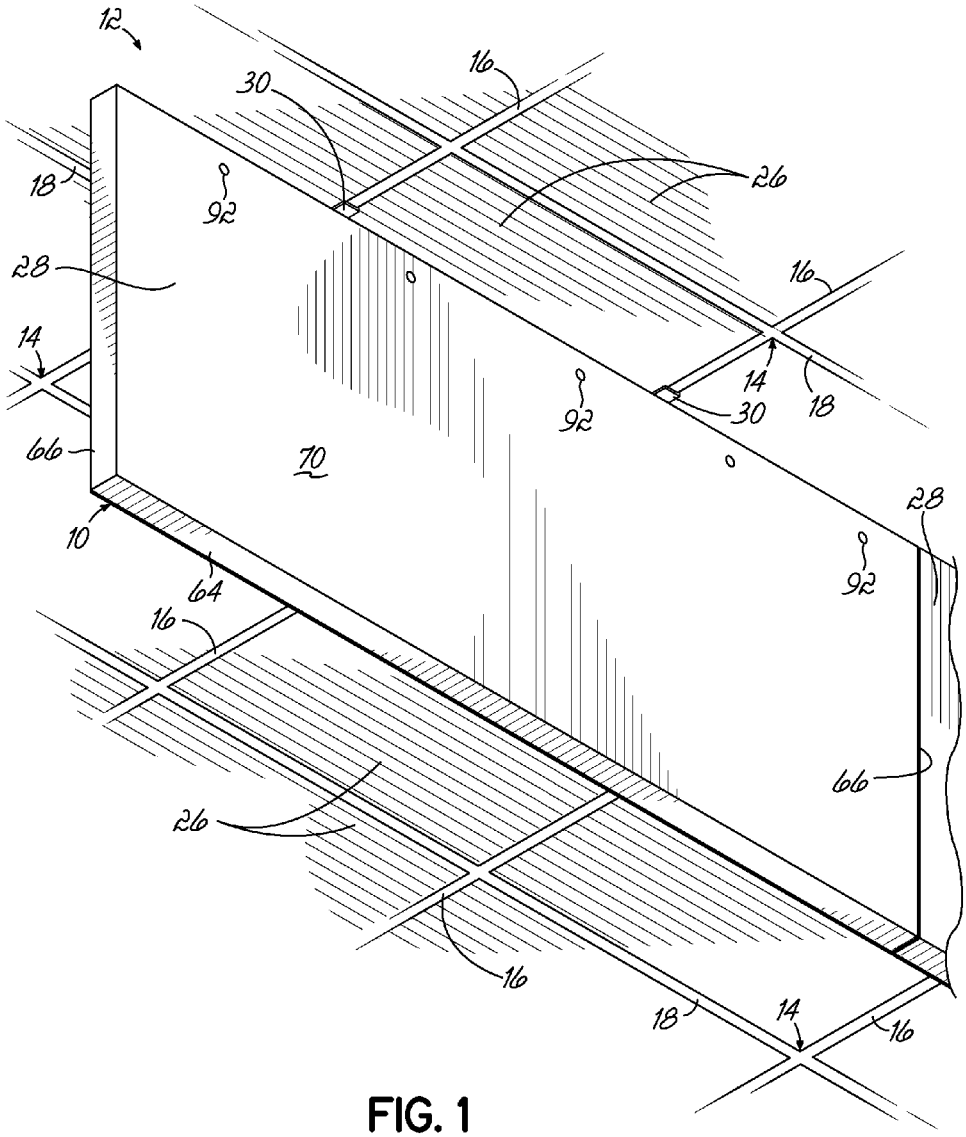
FIG. 1 is a perspective view of one embodiment of an overhead panel assembly according to the invention, as seen from ground level.
Figure 2:
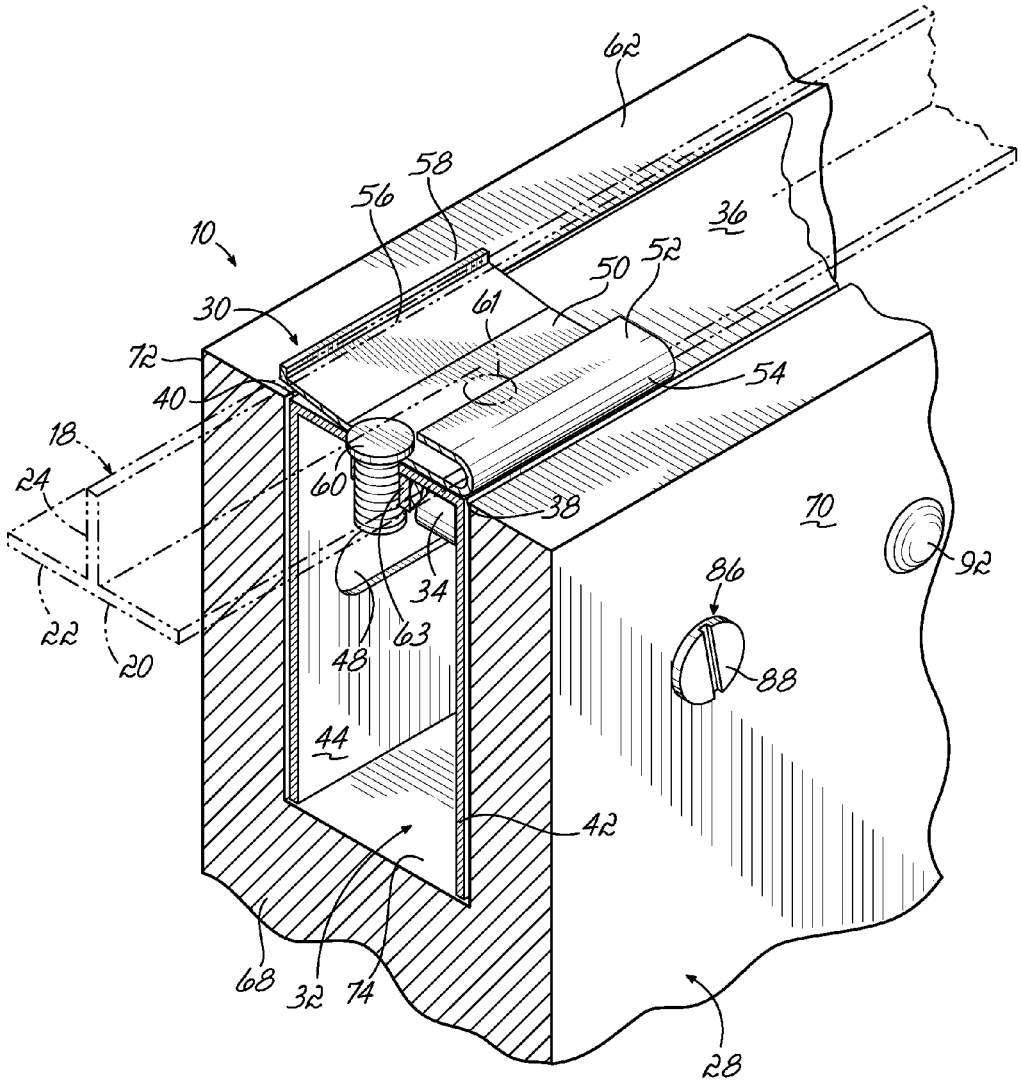
FIG. 2 is a perspective cross-sectional view of the overhead panel assembly of FIG. 1.
Figure 3:
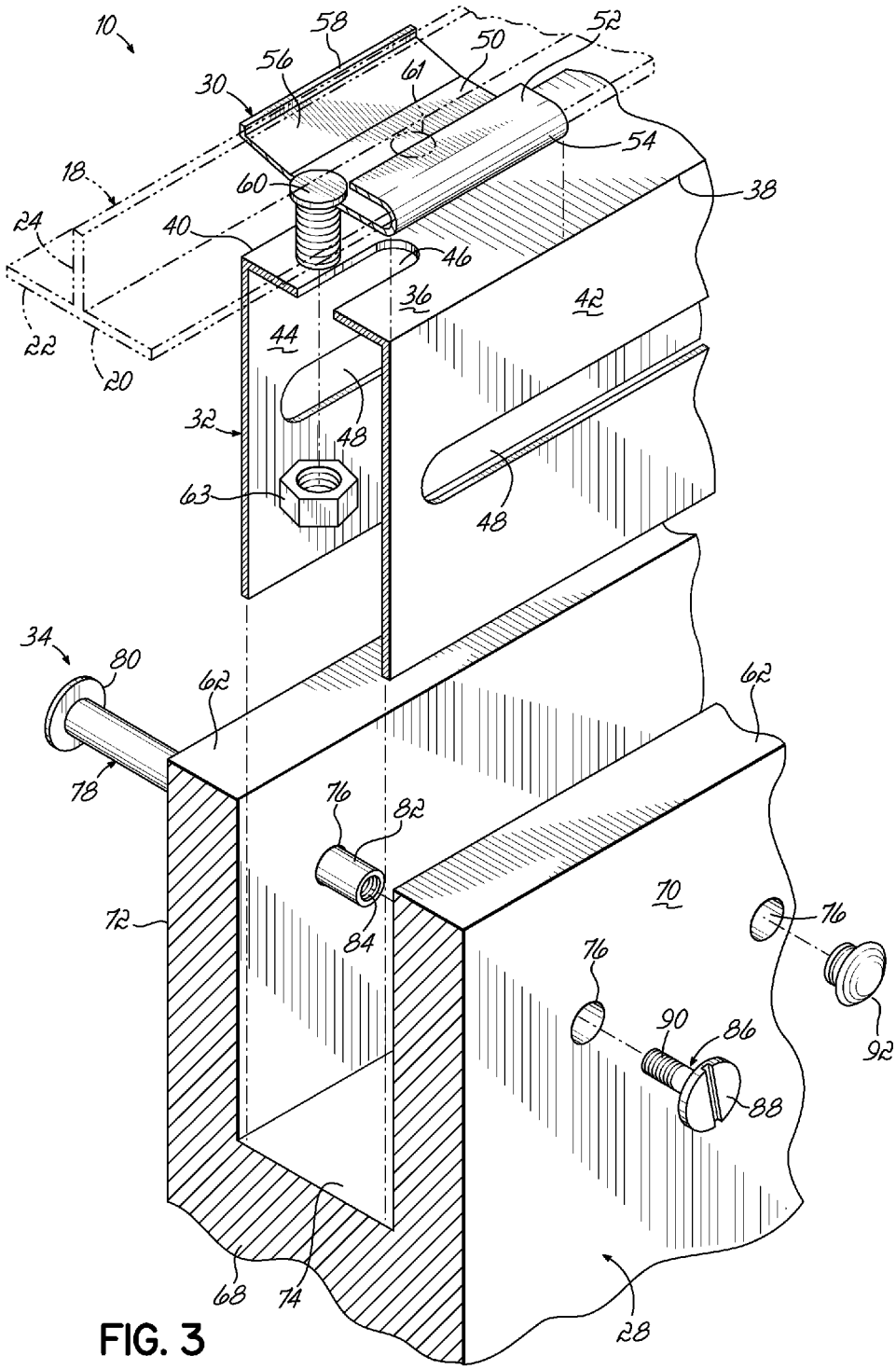
FIG. 3 is a perspective exploded view of the overhead panel assembly of FIG. 1.

FIGS. 1-3 illustrate an exemplary embodiment of an overhead panel assembly 10 for coupling to a drop ceiling 12. The invention may be utilized with a typical drop ceiling installation. In a larger commercial building, some areas are defined by a drop ceiling 12 mounted below a higher structural ceiling (not shown), and the invention is particularly useful in such a setting. As shown in FIG. 1, the drop ceiling 12 includes a support grid 14 formed by a plurality of lateral grid members 16 and a plurality of longitudinal grid members 18 interlocked with the lateral grid members 16 to form the ceiling grid 14. Exemplary grid members 16, 18 have a generally upside-down T-shaped cross-section most clearly shown in FIG. 2, including a horizontal cross member with a first horizontal flange 20, and a second horizontal flange 22 on opposite sides of a vertical member or flange 24. A plurality of horizontal lightweight panels 26 are dropped into position on the support grid 14 so that the panels 26 are supported at their edges on respective horizontal flanges 20, 22, thereby forming the drop ceiling 12.

In accordance with one embodiment of the invention, the overhead panel assembly 10 provides a platform for mounting at least one overhead, vertical panel 28 that is supported on the support grid 14 of the drop ceiling 12, as will be discussed in further detail below. The overhead panel 28 drops down in a generally vertical orientation from the plane of the ceiling 12 and can be combined with additional panels 28 or used individually to form a display, decorative soffit, valance, bulkhead, or other suitable structure that extends downwardly from the ceiling 12. These soffits, valances, and other structures aesthetically separate areas within a large retail or commercial space without requiring connection to and support from the higher structural ceiling of a building.

FIGS. 2 and 3 illustrate a cross-sectional view of the overhead panel assembly 10 in accordance with one exemplary embodiment. The overhead panel assembly 10 includes a grid clip 30, an elongate support channel 32, one or more panels 28, and a plurality of binding members 34 (one shown in FIGS. 2 and 3). The elongate support channel 32 is generally U-shaped and oriented in an upside down mounting to extend downwardly from the drop ceiling 12.

More specifically, the support channel 32 includes an upper generally horizontal plate section 36 having a first edge 38 and a second edge 40, a first vertical sidewall section 42 extends downwardly from the upper plate section 36 at the first edge 38, and a second vertical sidewall section 44 extends downwardly from the upper plate section 36 at the second edge 40. The upper plate section 36 includes a plurality of top apertures 46 that are formed therein along the length of the channel 32. The apertures 46 may be elongate as shown in this embodiment. The first and second vertical sidewall sections 42, 44 include a plurality of side apertures 48, which are also formed in the channel along its length and are elongate along the channel 32, and specifically along the length of the sidewall sections 42, 44. The side apertures 48 are substantially in alignment on both the vertical sidewall sections 42, 44 so that the side apertures 48 are in communication with each other in elevation for mounting the panel 28.

Figure 2A:
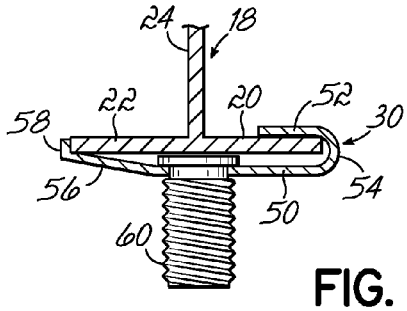
FIG. 2A is a cross-sectional view of a clip element of the invention engaging a ceiling grid member.

The grid clips 30 couple the support channel 32 to the support grid 14 of the drop ceiling 12. The grid clips 30 each include a generally horizontal portion 50, a hook arm 52 extending from a curved edge 54 of the horizontal portion 50, and an angled arm 56 extending from the horizontal portion 50 opposite the hook arm 52. The angled arm 56 may also include a vertical lip 58 spaced from the horizontal portion 50. As shown in FIGS. 2, 2A, and 3, the hook arm 52 is configured to wrap around one of the flanges 20, 22 of a grid member 18 so that the horizontal portion 50 of the grid clip 30 is closely held directly underneath the cross member of the grid members 16, 18. The angled arm 56 and vertical lip 58 extend upwardly to engage the other horizontal flanges 20, 22 of the grid members 16, 18 to provide additional stability and support for the grid clip 30.

Grid clip 30 also includes an attachment member 60 extending generally downwardly from portion 50 and supported by portion 50. For illustration, the attachment member is shown at an edge of the clip 30. However, it will be understood that the attachment member will be mounted generally in the center of the clip, as shown by reference numeral 61 and further illustrated in FIG. 4, or where most appropriate for ultimately supporting the channel 32. The attachment member 60, in one example, may be a threaded bolt 60, as shown in the illustrated embodiment. The threaded bolt 60 extends through one of the top apertures 46 in the support channel 32. A threaded nut 63 is secured with the threaded bolt 60 to closely couple the horizontal portion 50 of the grid clip 30 and the upper plate section 36 of the support channel 32 to mount the support channel 32 from the drop ceiling grid 14. Thus, the support channel 32 is mounted in close relationship to the drop ceiling 12. It will be understood that the attachment member 60 may be formed integrally with the horizontal portion 50 of clip 30, or may be attached separately to the grid clip 30, and the attachment member 60 may comprise other known fastener structures to engage channel 32. It will also be understood that two or more grid clips 30 may be used along the length of the elongate support channel 32, as necessary, to couple and support the panel 28 and the support channel 32 with the drop ceiling 12.

The panel 28 is illustrated as rectangular in one embodiment, and includes an elongate upper edge 62, an elongate lower edge 64, and opposing side edges 66. Of course, panel 28 can take any suitable shape, length, or width. The panel 28 in one embodiment contains a cellular core 68 having first and second side walls 70, 72 that are covered by a veneer or laminated outer skin. The lower edge 64 is also appropriately covered as are other exposed panel surfaces. The veneer or outer skin may be any color according to the desired display, valance, or soffit to be formed. The cellular core 68 may be made of a foam material that allows the vertical panel 28 to be lightweight, for example, around 1-2 pounds per linear foot of elongate length. The cellular core can be a material like expanded polystyrene, for example. This weight can be fully supported on the support grid 14 of a drop ceiling 12 without causing damage to the drop ceiling, and without having to be further supported by or attached to the higher structural ceiling. The side panels 70, 72 and outer skin may be formed of a suitable lightweight material, such as high impact polystyrene or expanded PVC, for example.

An elongate groove 74 may be cut into the middle of the cellular core 68 along the elongate upper edge 62, as shown in FIGS. 2 and 3. In the illustrated embodiment, the groove has a rectangular or square cross-section. The groove 74 is sized and shaped to slide over and surround the support channel 32 such that the elongate upper edge 62 of the panel is substantially level or coplanar with the upper horizontal plate section 36 of the support channel. In that way, the channel 32 is hidden from view. As is shown in FIGS. 2 and 3, the groove is sized and dimensioned to closely fit the channel. The panel 28 also includes a plurality of horizontal apertures 76 spaced along the first and second side surfaces 70, 72. The apertures extend through the panel, such that the horizontal apertures 76 are in communication with the groove 74. The apertures 76 are positioned on panel 28 so as to align with the channel apertures 48 for securing panel 28 to channel 32.

Referring to FIGS. 2 and 3, the vertical panel 28 may be positioned over channel 32, and slid upwardly so that the support channel 32 engages and slides into the groove 74, as shown in FIG. 2. As noted, groove 74 is of a suitable size to completely receive channel 32 so that the top surface 62 of panel 28 is flush with the ceiling 12 (see FIG. 1). Although FIGS. 2 and 3 illustrate a tight fit, groove 74 may be deeper than the depth of channel 32. In this position, a plurality of the horizontal apertures 76 in the vertical panel 28 are aligned with the elongate side apertures 48 in the first and second vertical sidewall sections 42, 44 of the support channel 32. A plurality of binding members 34 are then inserted through the horizontal apertures 76 and the side apertures 48 to couple the vertical panel 28 to the support channel 32.

Each binding member 34 is long enough to span the width of the panel 26 and support the weight of the panel 26 in the channel apertures 48. The illustrated exemplary binding member 34 may include a binding post 78 having a head 80 and a cylindrical hollow shank 82 with internal threads 84. Each binding member 34 may also include a binding screw 86 with a head 88 and a threaded post 90 configured to engage and screw into the cylindrical hollow shank 82. The heads 80, 88 hold against the sidewall surfaces 70, 72. The apertures 76 may be sized slightly larger than the cross-section of the binding members, so the binding members slide freely therethrough. In the illustrated embodiments, the apertures 76 might be positioned at various positions (e.g. every 12 inches) along the length of the panel for flexibility in mounting the panels. However, since a smaller number of binding members will provide adequate support, several apertures may remain unused. A button 92 may be slid into an unused aperture 76 to fill in the holes for aesthetic purposes. To conceal the binding member 34 and heads 80, 88 from the outside of the overhead panel assembly 10, the heads might be painted to match the color of the sidewalls 70, 72. Alternatively, a colored piece of an adhesive tape might be placed over the heads 80, 88. The button 92 or any adhesives may be colored or tinted to match the veneer or laminated skin on the side panels 70, 72 of the vertical panel 28.

In operation, a decorative soffit, valance, or other structure may be assembled using the overhead panel assembly 10. A plurality of grid clips 30 are coupled to the support grid 14 of a drop ceiling 12 by sliding the hook arm 52 of the grid clips 30 onto a horizontal flange 20, 22 of the support grid 14. A support channel 32 is then positioned against the grid clips 30 so that the attachment member 60 extends through the top apertures 46 in the support channel 32. The clips 30 may be slid and positioned on grid 14, as desired. Also, the apertures 46 are elongated to allow the channel 32 to be slid lengthwise along the members 60 for positioning. Once the support channel 32 is locked into position on the grid clips 30 using members 60 and threaded nuts 63 or other fasteners, a vertical panel 28 is slid up onto the support channel 32 such that the support channel 32 is disposed within the elongate groove 74 on the upper edge 62 of the panel 26.

To complete the assembly 10, a plurality of binding members 34 are inserted through spaced horizontal apertures 76, along the length of the panel 28 and through corresponding side apertures 48 in the support channel 32, thereby coupling the panel 28 and the support channel 32 together. Consequently, a decorative soffit, valance, display, or other structure is formed by the vertical panels 28 extending downwardly from the drop ceiling 12 without requiring any other connection to the support grid 14.

As will be appreciated, the various panels can be mounted end-to-end in order to form the desired structure that hangs down from the ceiling. For example, a channel 32 and panel 28 might be configured such that a channel supports multiple panels. Alternatively, a single panel might span, and be supported by, two adjacent channels 32. It would be understood by a person of ordinary skill in the art that various dimensions in the length of the channels 32 and panels 28 may be used so as to accommodate various different installations. Adjacent panels also might be angled with respect to each other, and thus, the edges 68 of the panels 28 may be appropriately angled, or beveled, to achieve the desired installation. When installed, the edges of the panel 28 might be simply abutted. Alternatively, they might be joined by another physical structure, such as that illustrated within U.S. Pat. No. 7,152,383, which is incorporated herein by reference in its entirety. Any exposed edges 68 may be covered with the same skin or laminate that forms the sidewalls 70, 72 of panel 28. In that way, various different displays, valances, soffits, or other structures might be formed as desired.

Figure 4:
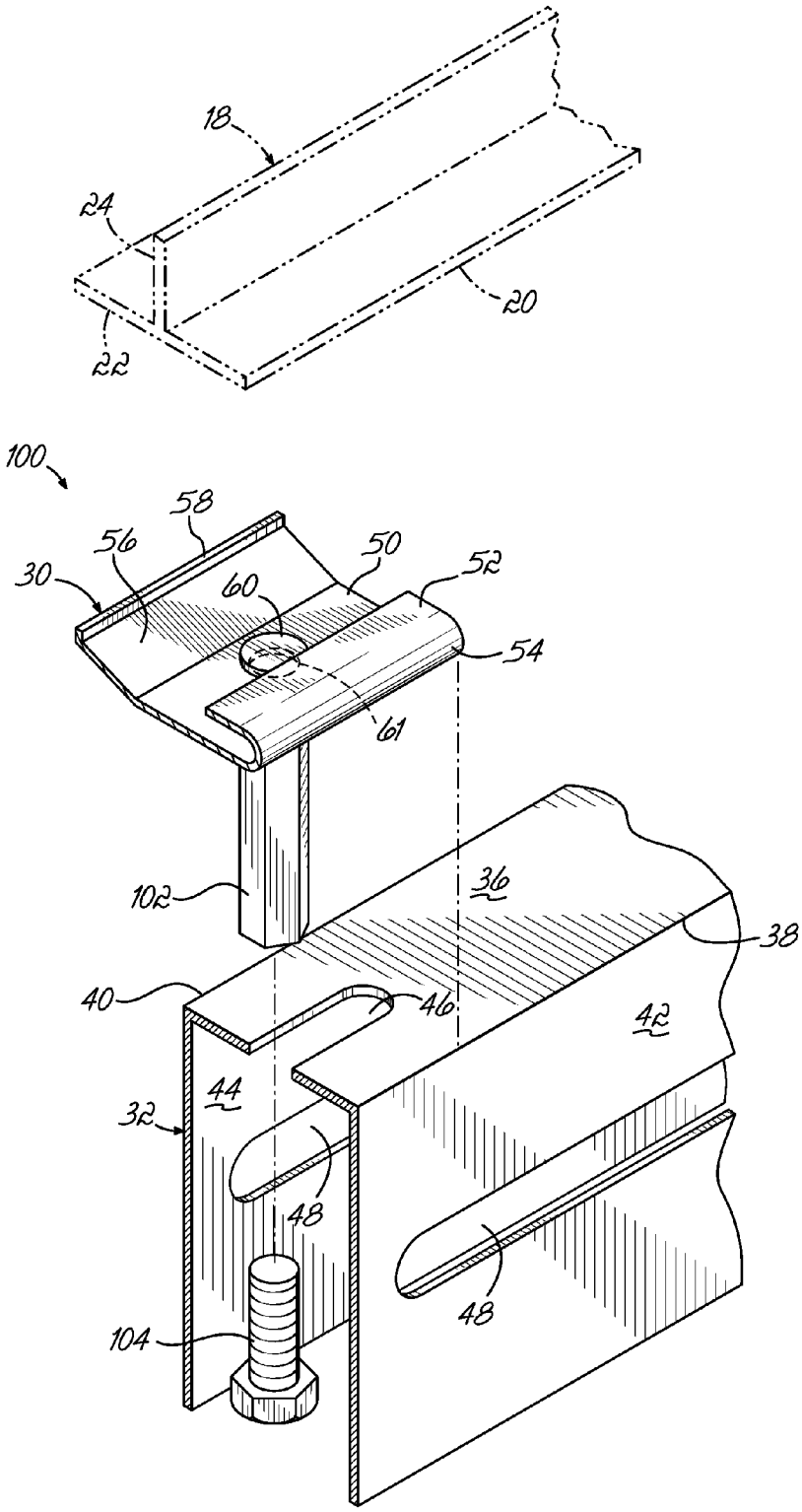
FIG. 4 is a perspective exploded view of an alternative embodiment of the overhead panel assembly.

A second embodiment of the overhead panel assembly 100 is illustrated in FIG. 4. This overhead panel assembly 100 includes many of the same elements and reference numerals as the overhead panel assembly 10 of the previous embodiment, including a grid clip 30, an elongate support channel 32, a vertical panel 28 (not shown in FIG. 4), and a plurality of binding members 34 (not shown in FIG. 4). The assembly 100 might be used when it is desirable or necessary to maintain some spacing between the ceiling 12 and the top edge of the panels 28. In this embodiment, the grid clip 30 includes a spacing member 102 extending downwardly from the horizontal clip portion 50 and below ceiling grid 18. The spacing member 102 may take any suitable form. In one embodiment, the spacer is a hex coupler 102 having internal threading to couple with the attachment member 60 at the grid clip 30. The spacing member then couples with a fastener, such as a connection screw 104, inserted upwardly through the top apertures 46 in the upper horizontal plate section 36 of the support channel 32. Alternatively, the spacing member 102 may be integrally formed with the grid clip 30 to replace the attachment member 60 in some embodiments. The spacing member 102 allows the vertical panel 28 and support channel 32 to be mounted a short distance away from the clip and the drop ceiling 12, thereby forming a clearance space above the formed structure. This assembly 100 can be advantageous in situations where the structure, soffit, or valance has to be mounted in the area of obstructions extending below the drop ceiling 12, including return vents and fire sprinklers, for example.

In many applications, the structure, soffit, valance, or display to be mounted will be 50 feet long or longer and may not be completely linear from one end to another. In a third embodiment of the overhead panel assembly, a plurality of grid clips 30, support channels 32, vertical panels 28, and binding members 34 are used in combination to mount a continuous series of vertical panels 28 on the drop ceiling 12. To provide the appearance of a continuous soffit and stabilize the assembly, adjacent vertical panels 28 may be joined together, as noted above. Adjacent support channels 32 may also be joined together. Attaching adjacent vertical panels 28 having cellular cores 68 may be accomplished with a specially designed fastener mounted on the side edges 66 of the panels 28. As noted, one exemplary panel fastener is the SlideLite® fastening system disclosed in U.S. Pat. No. 7,152,383, owned by the assignee of this application, and the disclosure of which is fully incorporated by reference in its entirety herein. Thus, the vertical panels 28 abut and engage each adjacent panel 28 in the series to form a continuous decorative soffit or valance.

Figure 5A:
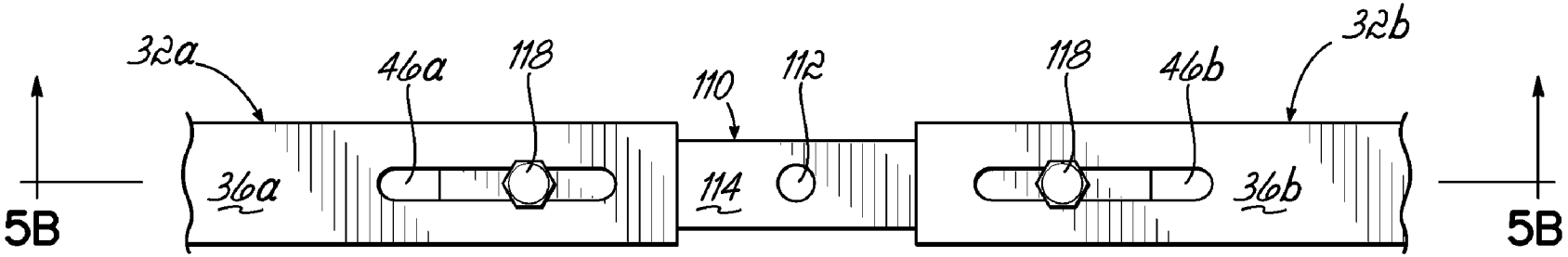
FIG. 5A is a top view of another alternative embodiment of the overhead panel assembly, including a mending plate.
Figure 5B:
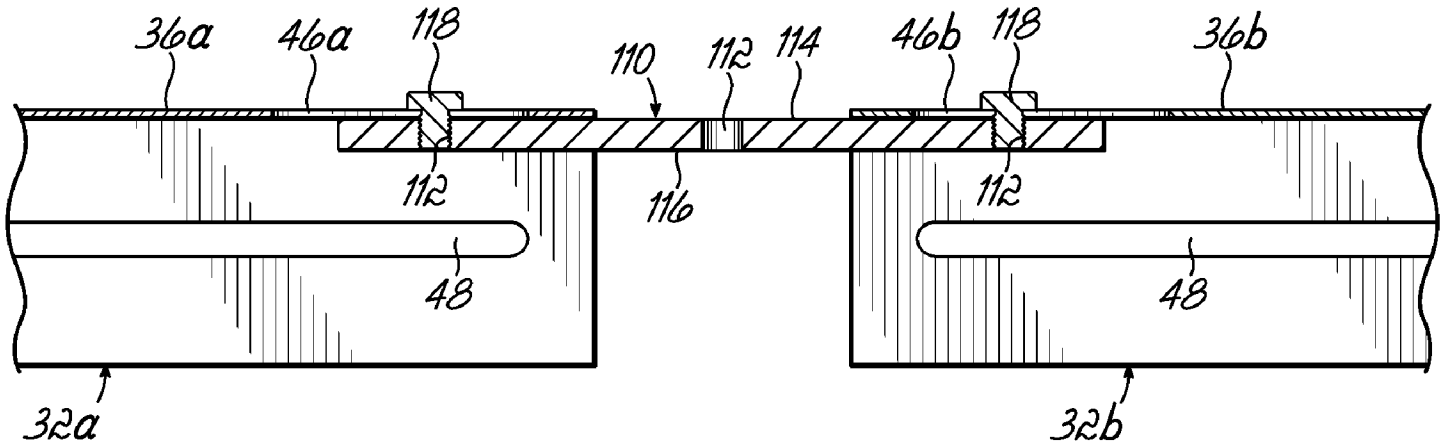
FIG. 5B is an elevation view of the overhead panel assembly of FIG. 5A.

To couple adjacent support channels 32*a*, 32*b*, the overhead panel assembly may further include a mending plate 110 as shown in FIGS. 5A and 5B. The mending plate 110 is an elongate generally rectangular bar having a plurality of apertures 112 extending vertically through the upper face 114 and lower face 116 of the mending plate 110. The mending plate 110 is inserted into the U-shaped support channels 32*a*, 32*b* into engagement with the respective upper horizontal plate sections 36*a*, 36*b*. A pair of bolts 118 or similar fasteners may then be inserted through the top apertures 46*a*, 46*b* and engaged with the vertical apertures 112 in the mending plate 110. Therefore, the mending plate 110 provides a structural connection between two adjacent support channels 32*a*, 32*b* without impeding the connection of those support channels 32*a*, 32*b* to respective vertical panels 28 and grid clips 30.

While the present invention has been illustrated by the description of the embodiment thereof, and while the embodiment has been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. An overhead panel assembly system for coupling to a drop ceiling, the system comprising:

a support channel having an upper section with a plurality of top apertures and having at least one sidewall section extending downwardly from the upper section, the sidewall section including a plurality of side apertures;

a clip configured to slide into engagement with a grid member of the drop ceiling, the clip, including an attachment member extending from the clip and configured to extend through at least one of the top apertures of the support channel, to couple the clip to the support channel;

a vertical panel having a cellular core and a groove formed in the core along an upper edge of the panel, the panel configured to slide onto the support channel such that the support channel is substantially disposed within the groove; and a plurality of binding members, the binding members inserted through the vertical panel and the side apertures in the support channel to couple the panel to the support channel.

2. The overhead panel assembly system of claim 1, wherein the support channel includes a plurality of sidewall sections, substantially parallel with each other.

3. The overhead panel assembly system of claim 2, wherein the support channel has a U-shaped cross-section formed by the upper section and sidewall sections.

4. The overhead panel assembly system of claim 1, wherein the panel is coupled to the support channel such that the upper edge of the panel and the upper section of the support channel are coplanar.

5. The overhead panel assembly system of claim 1, wherein the attachment member includes a bolt, and the support channel is coupled to the clip with a nut coupled to the bolt.

6. The overhead panel assembly system of claim 1, wherein the attachment member is configured to hold the support channel upper section at least one of close to or in contact with the clip such that the panel is adjacent to a drop ceiling.

7. The overhead panel assembly system of claim 1, wherein the attachment member is configured to hold the support channel upper section spread away from the clip such that the panel is spaced from a drop ceiling.

8. The overhead panel assembly system of claim 1, further comprising:

a spacing member having a first end coupled to the attachment member and a second end coupled to the upper section of the support channel, the spacing member forming a clearance space between the drop ceiling and the support channel and panel.

9. The overhead panel assembly system of claim 1, wherein at least one of the binding members further comprises a binding post for engaging the side apertures of the support channel and a binding screw configured to engage the side apertures and engage the binding post to couple the panel and the support channel.

10. The overhead panel assembly system of claim 1, wherein a plurality of support channels and vertical panels are aligned in series.

11. The overhead panel assembly system of claim 10, wherein a plurality of vertical panels are joined at the adjacent side edges to maintain an abutting and engaged relationship of all the vertical panels.

12. The overhead panel assembly system of claim 10, further comprising:

an elongate mending plate having a plurality of apertures and configured to be coupled to adjacent support channels by bolts inserted through top apertures of the support channel and the mending plate apertures.

13. An overhead panel assembly system for coupling to a drop ceiling, the system comprising:

a support channel having an upper section with at least one top aperture and having at least one sidewall section extending downwardly from the upper section, the sidewall section including at least one side aperture;

a clip configured to engage a grid member of the drop ceiling, the clip including an attachment member extending therefrom and configured to extend through the at least one top aperture of the support channel, to couple the clip to the support channel;

a vertical panel having a groove formed in a core of the panel along an upper edge of the panel, the panel configured to slide onto the support channel such that the support channel is substantially disposed within the groove; and a binding member, the binding member extending through the vertical panel and the at least one side aperture in the support channel to couple the panel to the support channel.

14. The overhead panel assembly system of claim 13, wherein the support channel includes a plurality of sidewall sections.

15. The overhead panel assembly system of claim 13, wherein the attachment member includes a bolt.

16. The overhead panel assembly system of claim 13, further comprising:

a spacing member having a first end coupled to the attachment member and a second end coupled to the upper section of the support channel, the spacing member forming a clearance space between the drop ceiling and panel.

17. The overhead panel assembly system of claim 13, wherein the binding member further comprises a binding post for engaging the at least one side aperture of the support channel and a binding screw configured to engage the side aperture and engage the binding post to couple the panel and the support channel.

* * * * *